US008651275B1

(12) United States Patent
D'Aloisio

(10) Patent No.: US 8,651,275 B1
(45) Date of Patent: Feb. 18, 2014

(54) FLATWARE NAPKIN HOLDER

(76) Inventor: Marlene D'Aloisio, North Babylon, NY (US)

( * ) Notice: Subject to any disclaimer, the term of this patent is extended or adjusted under 35 U.S.C. 154(b) by 394 days.

(21) Appl. No.: 13/165,207

(22) Filed: Jun. 21, 2011

(51) Int. Cl.
*B65D 73/00* (2006.01)
*A45F 5/04* (2006.01)

(52) U.S. Cl.
USPC ..... 206/494; 206/553; 24/7

(58) Field of Classification Search
USPC ..... 206/494, 553; 24/7; 229/87.01–87.13; D7/631–637
See application file for complete search history.

(56) References Cited

U.S. PATENT DOCUMENTS

| | | | | | |
|---|---|---|---|---|---|
| 1,865,922 | A | | 7/1932 | Kowalewski | |
| 1,979,876 | A | * | 11/1934 | Fischer | 206/494 |
| 3,274,045 | A | | 9/1966 | Smith | |
| 3,294,229 | A | * | 12/1966 | McConnell et al. | D7/631 |
| 3,376,974 | A | * | 4/1968 | Hilliard | 206/553 |
| 3,398,438 | A | * | 8/1968 | Louis et al. | 24/7 |
| 3,965,591 | A | * | 6/1976 | Le Sueur | D7/633 |
| 3,978,553 | A | | 9/1976 | Honig | |
| 4,177,846 | A | | 12/1979 | Rountree | |
| 4,800,108 | A | | 1/1989 | Swartz | |
| 5,011,017 | A | | 4/1991 | Giesen | |
| D396,781 | S | * | 8/1998 | Schutte et al. | D7/631 |
| D486,026 | S | | 2/2004 | Wong | |
| 6,918,226 | B2 | * | 7/2005 | Heilman et al. | 53/211 |
| 7,266,865 | B1 | * | 9/2007 | Rodin | 24/7 |
| D568,173 | S | * | 5/2008 | Rutjes | D9/720 |
| 7,412,808 | B2 | * | 8/2008 | Lavi | 53/228 |
| 7,698,875 | B2 | | 4/2010 | Matsuoka et al. | |
| 7,913,478 | B2 | * | 3/2011 | Lavi | 53/466 |
| 8,528,306 | B2 | * | 9/2013 | Elsaesser et al. | 53/459 |
| 2007/0119912 | A1 | | 5/2007 | Blanton et al. | |
| 2008/0110787 | A1 | * | 5/2008 | Hummerich | 206/494 |
| 2010/0044271 | A1 | * | 2/2010 | McMillan | 206/553 |

* cited by examiner

*Primary Examiner* — Bryon Gehman
(74) *Attorney, Agent, or Firm* — Goldstein Law Offices, P.C.

(57) ABSTRACT

A flatware napkin holder combining three elements, a rectangularly folded dinner napkin, a triangular-shaped napkin enfolding a place setting of flatware and a customizable pouch having a closed bottom, closed sides and an open top, the dinner napkin, luncheon napkin and flatware sitting inside the pouch, extending through the open top. The pouch is customizable to complement a motif for any festive occasion with an additional ornamentation. The flatware napkin holder can be used as a place card holder for a table having assigned seats. The dinner napkin, the luncheon napkin, the pouch and the pouch ornamentation can be the same color or complementary colors, using two or more colors, resulting in an exceedingly large number of possible combinations to match any color theme of the decorating motif.

7 Claims, 4 Drawing Sheets

FLATWARE NAPKIN HOLDER

BACKGROUND OF THE INVENTION

The invention relates generally to a holder for a pair of table napkins and flatware. More particularly, the invention relates to a customizable holder enfolding a place setting of flatware and a pair of table napkins for setting a decorated dining table.

People have been using table napkins for centuries to wipe their chin and to prevent food from falling and staining clothes. Tableware, such as eating utensils and dishes, has been used equally long, many believing that such table settings date back to ancient Rome. How the eating utensils, dishes and table napkins are to be arranged in each individual place setting varies with time, custom and occasion. Informal dining at home generally has plain dishes, utensils and napkins, sometimes haphazardly set out on the table. Formal dining, such as in an expensive restaurant, or for formal occasions at home, has tables set in a precise arrangement, using china dishes, silver flatware and cloth napkins. Celebratory dining for a festive or holiday occasions have the most elaborate place settings, enhancing the dishes, flatware and napkins with decorations, place cards, color themes and centerpieces.

Many have proposed ways of taking the table napkin and either folding or modifying the napkin to add a touch of festivity or elegance to the set table. One solution is to fold the napkin into a rhombus with a pocket for the flatware. Others have cut designs into the border of a napkin, so that when folded according to the method described therein, the cut designs are displayed. Others deviations from the traditional square shape of the napkin have been tried, having a particular shape and surface ornamentation, similar to a dinner jacket. Others have created additional pockets for flatware, attaching to the basic square napkin.

Other assorted linens have been proposed to hold flatware in a more fanciful or decorative manner. One has created a placemat with an attached pocket for flatware and an attached ring for the napkin. Another proposed a cloth flatware holder to hold many place settings or multiples of one type of utensils that can be spread out to present the flatware on a buffet. Others have folded towels into fancy shapes to use as centerpieces.

While these units may be suitable for the particular purpose employed, or for general use, they would not be as suitable for the purposes of the present invention as disclosed hereafter.

SUMMARY OF THE INVENTION

It is an object of the invention to produce a holder for a place setting of flatware that keeps the flatware clean and sanitary before use. Accordingly, the invention is a holder for flatware that enfolds a napkin that in turn, enfolds the place setting of flatware so that when a table is set, the flatware is not touched and does not touch a surface below.

It is another object of the invention to produce a holder for a plurality of napkins that is customizable to complement a plurality of decorations for a special, festive occasion. Accordingly, the invention is a flatware napkin holder having a customizable pouch to hold a place setting of flatware and at least one napkin, the pouch decoratively and selectively cut and folded in a plurality of shapes and decorated with ornamentation, customized to complement the decorations for the occasion.

The invention is a flatware napkin holder combining three elements, a rectangularly folded dinner napkin, a triangularly folded luncheon napkin enfolding a place setting of flatware and a customizable pouch having a closed bottom, closed sides and an open top, the dinner napkin, luncheon napkin and flatware sitting inside the pouch, extending through the open top. The pouch is customizable to match a motif for any festive occasion with an additional ornamentation. The flatware napkin holder can be used as a place card for a table having assigned seats. The dinner napkin, the luncheon napkin, the pouch and the pouch ornamentation can be the same color or complementary colors, using two or more colors, resulting in an exceedingly large number of possible combinations to match any color theme of the decorating motif.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
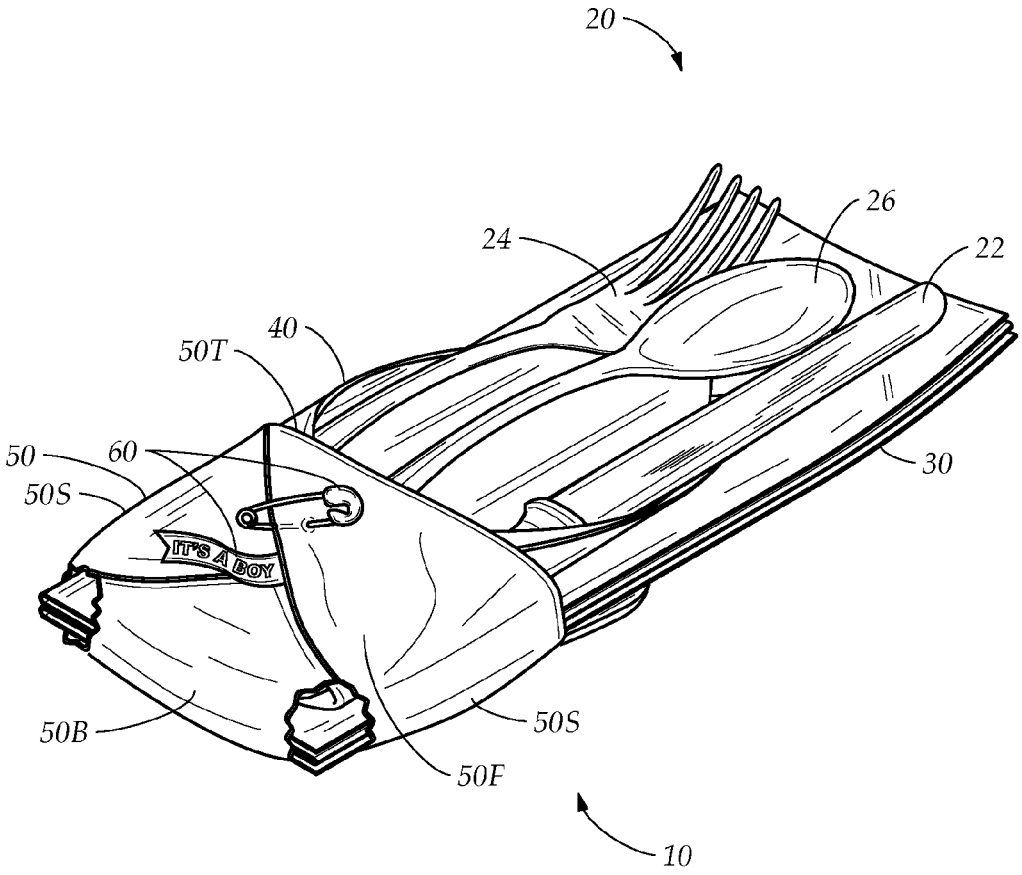
FIG. 1 is a diagrammatic perspective view of a holder for a place setting of flatware and a pair of napkins, customized for a baby shower with a diaper design.

FIG. 1 illustrates a flatware napkin holder 10 fully assembled for placing on a dining table. The flatware napkin holder 10 is useful for the dining table set with a plurality of individual place settings. The napkin holder, holding a place setting of flatware 20 and at least one napkin 30, is useful in a buffet setting where the guest can select the napkin holder 10 with the flatware and napkin along with dishes, glassware and selected food items. The holder provides a decorative and festive touch to the table as well as conveniently and practically maintaining the flatware 20 and at least one napkin 30 together for the guest to use while dining.

The flatware napkin holder 10 combines three elements, a rectangularly folded dinner napkin 30, a triangularly folded luncheon napkin 40 enfolding a place setting of flatware 20 and a customizable pouch 50 having a closed bottom 50B, a pair of closed sides 50S and an open top 50T, the dinner napkin 30, luncheon napkin 40 and flatware 20 sitting inside the pouch 50, extending out through the open top 50T. The pouch 50 has a front side 50F that is customizable to provide the decorative and festive touch to any celebratory occasion. In the non-limiting example, the pouch 50 is shaped to appear as a diaper, with a plurality of ornaments 60 to enhance the verisimilitude or further customize the pouch.

In this discussion, a dinner napkin 30 refers to a generally square piece of material, having four equal sides, a side ranging in length from about eighteen to twenty-four inches. A luncheon napkin 40 refers to a generally square piece of material, having four equal sides, a side ranging from about ten to fourteen inches, the material of fabrication of the napkins irrelevant. A place setting of flatware 20 varies in makeup according to custom and occasion. For the purpose of this discussion, a place setting refers to at least one eating utensil selected from the group consisting of a pair of chopsticks, a knife 22, a fork 24 and a spoon 26 that a guest needs to eat a meal on the particular occasion. The composition of the place setting of flatware is non-limiting. For example, when a multiple course meal is served, the guest needs several forks, spoons and knifes in the place setting and for a simple meal, the guest needs only a fork in the place setting.

Figure 3A:
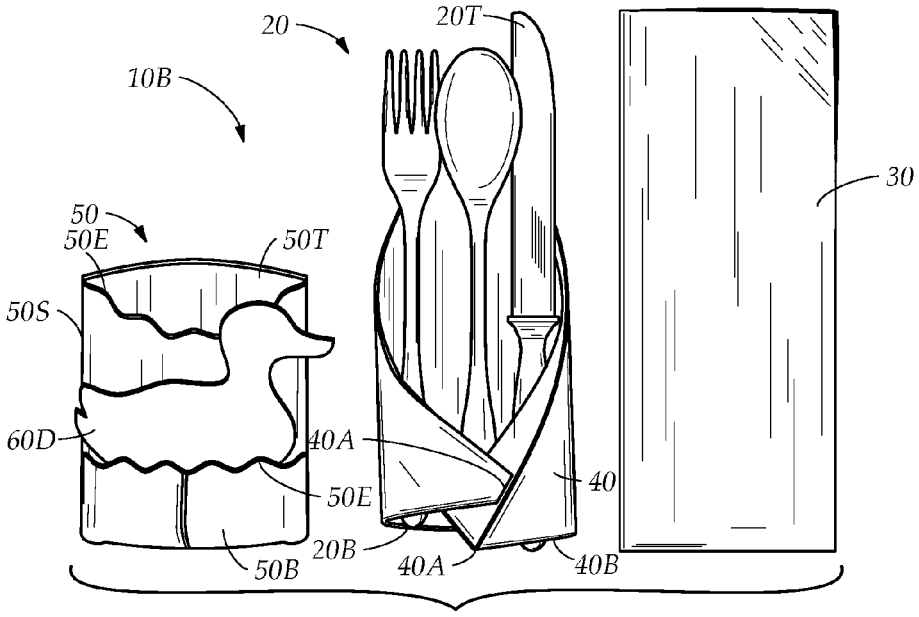
FIG. 3A is a top plan view of a plurality of unassembled elements of the invention.

Referring to FIG. 3A, the drawing shows the elements of the flatware napkin holder 10B before assembly. In this embodiment, the square dinner napkin 30 is folded into a rectangle, the rectangle having a plurality of equal rectangular segments. The square napkin has four sides and four corners, each corner connecting a pair of sides. The rectangle is formed by folding a first corner toward an adjacent second corner on the same side of the square, the rectangle having a pair of long sides and a pair of short sides. The square luncheon napkin 40 has a diagonal line connecting opposing corners. The luncheon napkin 40 is folded along the diagonal line into a pair of right triangular equal segments, each segment having a right ninety-degree corner at an apex and a pair of acute angle corners 40A at a bottom edge 40B. The triangle is formed by folding the square napkin along the diagonal, the diagonal forming a fold at the bottom edge 40B. In another embodiment, the luncheon napkin 40 is cut along the diagonal line to form the pair of right triangle segments. A place setting of flatware 20, the flatware each having a top 20T and bottoms 20B, is placed on the napkin triangle 40, the flatware bottoms 20B directed toward the bottom edge 40B. The forty-five degree angles 40A of the napkin triangle are folded inwardly toward each other, forming a bottom edge 40, the right angle at an apex. In the illustrated example, a first forty-five degree angle 40A is tucked inside the fold of a second forty-five degree angle 40A at the bottom edge 40B. The forty-five degree angles 40A also can overlap without tucking together, the pouch holding the angles together as described hereinbelow.

Figure 3B:
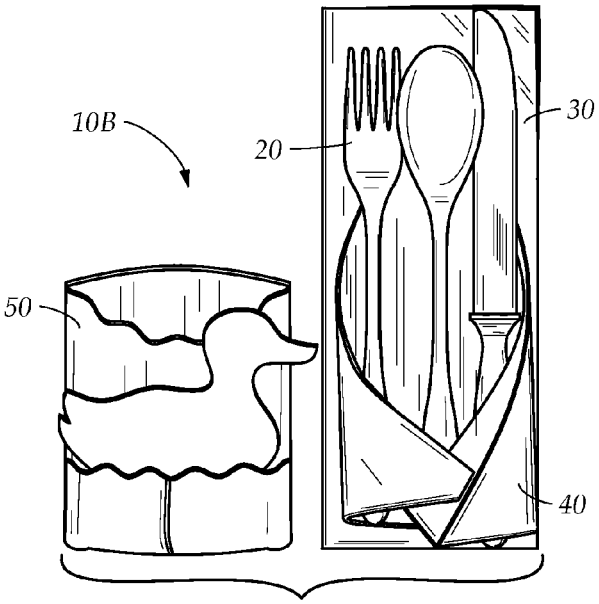
FIG. 3B, similar to FIG. 3A, is a top plan view of partially unassembled elements of the invention.
Figure 3C:
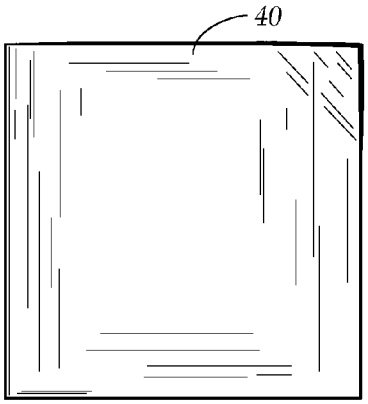
FIG. 3C, is a top plan view of a square napkin, an element of the invention.

FIG. 3C shows the square luncheon napkin 40 prior to folding or cutting.

As illustrated in FIG. 3A, the pouch 50 has been folded to have the pair of closed sides 50S, closed bottom 50B and open top 50T. In this non-limiting example, the pouch 50 has a pair of edges 50E, the edges 50E trimmed with a scalloped edging to represent waves on a body of water to coordinate with the ornamentation, which, in this illustration, is a duck 60D.

As illustrated in FIG. 3B, the flatware napkin holder 10B is further assembled, the flatware enfolded in the triangularly folded luncheon napkin 40 and placed on the rectangularly folded dinner napkin 30. FIG. 2B shows the completely assembled exemplary flatware napkin holder 10B, the flatware 20 enfolded in the triangularly folded luncheon napkin 40 and placed on the rectangularly folded dinner napkin 30 and the pair of napkins with the enfolded flatware placed into the pouch 50 through the open top 50T with the first short side of the rectangularly folded napkin 30 placed into the pouch and the second short side extending out the top of the pouch, the apex of triangularly folded napkin and the tops of the flatware also extending out the top of the pouch. It is understood by those of ordinary skill the flatware napkin holder can be assembled with only one napkin and the place setting placed in the pouch, the one napkin folded triangularly or rectangularly. It is also understood that the size of the napkins can vary and using two luncheon napkins or two dinner napkins, one folded triangularly and one folded rectangularly is within the inventive concept.

Figure 4A:
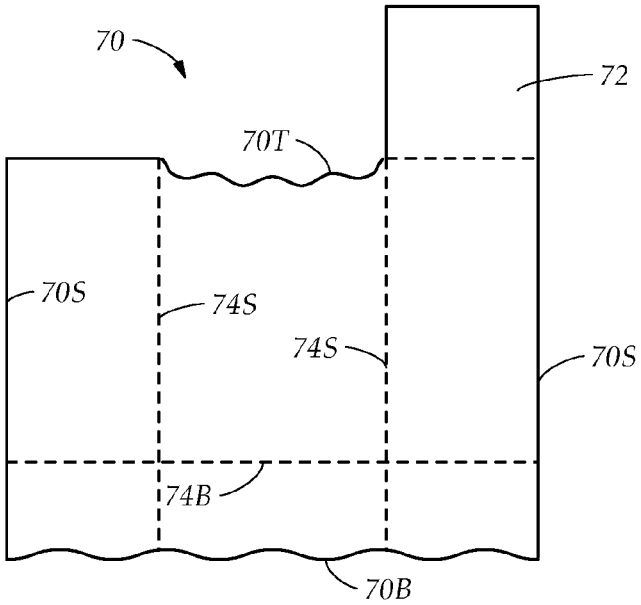
FIG. 4A is a top plan view of a template for a pouch for holding the flatware place setting and the napkins, the pouch creating a decorative wave effect.

FIG. 4A show a template for the pouch illustrated in FIG. 3A, FIG. 3B and FIG. 2B as a non-limiting example. The template 70 has a bottom edge 70B, a pair of side edges 70S, a top edge 70T and a tab 72. The template 70 has a plurality of fold lines 74, a bottom fold line 74B forming the bottom of the pouch, and a pair of side fold lines 74S forming the closed sides. When the closed sides of the pouch are formed by folding on the side fold lines 74S, the side edges 70S overlap, forming a back for the pouch. The tab 72 is optionally used to fold over to join the pair of side edges 70S to reinforce the back. The bottom edge of the front of the pouch is joined to the bottom edges of the overlapping sides. In this illustration, the template has the top edge 70T and a bottom edge 70B trimmed with scallops to represent waves on a body of water.

Figure 4B:
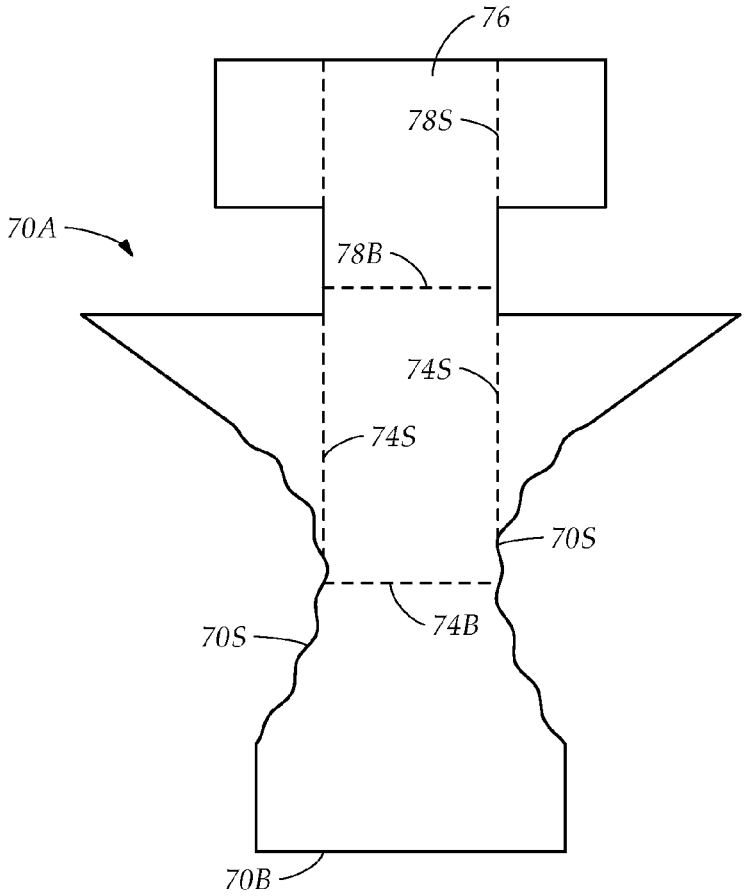
FIG. 4B, similar to FIG. 4A, is a top plan view of a template for a pouch for holding the flatware place setting and the napkins, the pouch forming a diaper.

FIG. 4B shows the template 70A for the pouch having a diaper design, illustrated in FIG. 1 as a non-limiting example. The template has a bottom edge 70B, two side edges 70S and a top T-shaped tab 76. The template has fold lines, a bottom fold line 74B forming the bottom, and a pair of side fold lines 74S forming the sides. The T-shaped tab 76 has a bottom fold line 78B and a pair of side fold lines 78S. The side edges 70S are contoured so that when the bottom fold line 74B is folded upward and the side folds lines 74S are folded and overlapped, the edge 70B becomes the top edge of the diaper and the side edges 70S form a pair of leg openings of the diaper. To prevent the flatware from slipping through the leg openings, the tab folds down at the bottom fold line 78B and the side fold lines 78S fold in forming a barrier to prevent the flatware from slipping through. In one example, the T-shaped tab 76 is cut from material of a different color and attached to the diaper template at the T-tab bottom fold line 78B.

It is understood that the illustrated templates in FIGS. 4A and 4B are non-limiting examples for pouch templates and that many variations within the inventive concept are possible to form and trim the edges of the pouch with the closed bottom, closed sides and open top to hold flatware and at least one napkin.

Figure 2A:
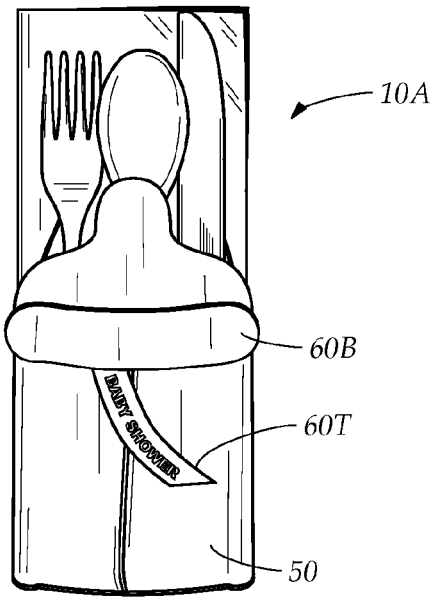
FIG. 2A is a top plan view of the holder for flatware and napkins, customized for a baby shower with a baby bottle ornamentation.
Figure 2B:
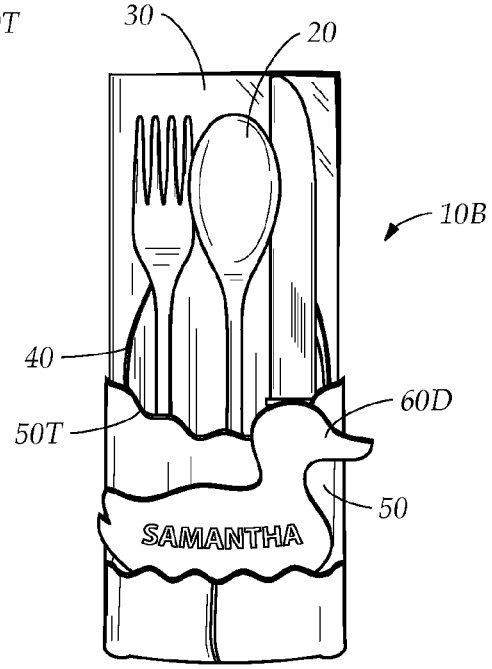
FIG. 2B, similar to FIG. 2A, is a top plan view of the holder for flatware and napkins, customized with a swimming duck ornamentation.
Figure 2C:
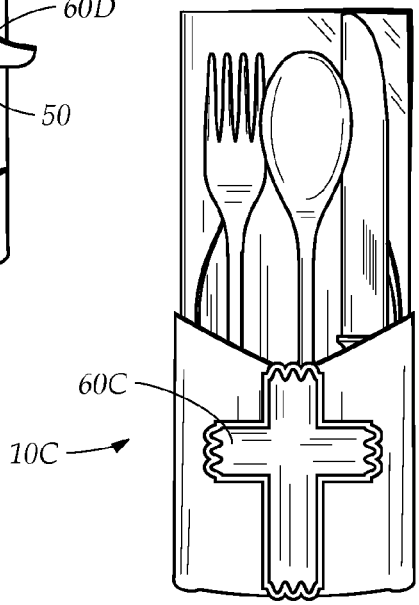
FIG. 2C, similar to FIG. 2A, is a top plan view of the holder for flatware and napkins, customized for a religious celebration.

FIG. 2A through FIG. 2C show different motifs possible within the flatware napkin holder. FIG. 2A shows the holder 10A with a baby bottle with a nipple ornament 60B, appropriate for a baby shower. The pouch 50 has an ornamental tag 60T, the tag displaying a message, a greeting, or a name, such as the name of the guest of honor. FIG. 2B shows the duck 60D swimming on the waves created by the scalloped edging of the pouch 50, appropriate for a child's party or baby shower. FIG. 2C shows a cross ornament 60C on the holder 10C, appropriate for a celebration of a Christian life cycle event, such as a christening, first communion or confirmation. These are non-limiting examples and the pouch can display ornamentation appropriate for any festive celebration such as, for example, but not limited to a birthday, anniversary, wedding, religious life cycle events of any religion, religious holidays, and national holidays. The ornamentation can display a logo, trade dress or products of a business when the event is sponsored by the business. The type and style of the ornamentation on the pouch is limitless. The napkins, the pouch and the pouch ornamentation can be the same color or complementary colors, using two or more colors and shades, resulting in an exceedingly large number of possible combinations to complement any color theme of the decorating motif.

The flatware napkin holder can also be used as a place card holder for a table having a plurality of assigned seats. As an example, referring to FIG. 2B, the host can write the guest's name on the duck 60D and place the flatware napkin holder 10B at the assigned seat for the guest. The guest's name can be written directly on the pouch or a tag added as an additional ornament. The flatware napkin holder keeps the flatware clean and sanitary before use as well as indicating the assigned seat, the holder preventing the flatware from being touched once it is placed in the holder, and preventing the flatware from touching a possibly dirty surface during table setting.

In a further embodiment of the invention, multiple pouches, without flatware or napkins, are assembled and attach at the closed sides, forming a polygon of three or more sides, the front sides of the pouches with the ornamentation forming the exterior sides of the polygon, the polygon standing upright on the pouch closed bottom sides, the open pouch top sides at the top of the polygon. Inside the polygon, other decorations such as, for example, but not limited to, a candle, a weight for a helium balloon or a nut cup may be placed. Using larger pouches in the polygon, a centerpiece can be assembled by placing the polygon around florist foam, a basket or a vase, as non-limiting examples, and adding a bouquet of flowers, balloons and other decorative accessories to the interior of the polygon.

In conclusion, herein is presented a customizable flatware napkin holder enfolding flatware and napkins for setting a decorated dining table. The invention is illustrated by example in the drawing figures, and throughout the written description. It should be understood that numerous variations are possible, while adhering to the inventive concept. Such variations are contemplated as being a part of the present invention.

What is claimed is:

1. A decorative holder for setting a table, comprising:

at least one square napkin, the at least one square napkin having four equal sides and four corners, each corner connecting a pair of sides, the at least one square napkin folded into a plurality of equal segments;

a place setting of flatware, the flatware placed on the folded at least one square napkin;

a pouch, having an open top, a pair of closed sides and a closed bottom, the flatware and the folded at least one square napkin placed into the pouch through the open top and extending out of the open top of the pouch, the pouch with the flatware and napkin placed on a table for use by a guest while dining; and an additional square napkin placed in the pouch, the additional square napkin having a diagonal line connecting opposing corners, the additional square napkin folded along the diagonal line, forming triangular segments, the segments having a right angle corner at an apex and a pair of acute angle corners, the additional square napkin further enfolding the flatware by folding the acute angle corners towards each other, the additional square napkin with the flatware placed into the pouch through the open top, the apex of the additional square napkin and the flatware extending out of the open top of the pouch.

2. A decorative holder for setting a table, comprising:

at least one square napkin, the at least one square napkin having four sides and four corners, each corner connecting a pair of sides, each corner having an opposing corner, the at least one square napkin having a diagonal line connecting two opposing corners, the at least one square napkin folded along the diagonal line, forming a right triangle with a right angle corner and a pair of acute angle corners;

a place setting of flatware, the flatware placed on the folded at least on square napkin, the at least one square napkin enfolding the flatware by folding the acute angle corners of the at least one square napkin towards each other;

a pouch, having an open top, a pair of closed sides and a closed bottom, the place setting of flatware enfolded by the at least one square napkin placed into the pouch through the open top and extending out of the open top of the pouch, the pouch with the flatware and the at least one square napkin placed on a table for use by a guest while dining; and an additional square napkin placed in the pouch behind the at least one square napkin folded into a triangle, the additional square napkin folded into a rectangle, by folding a first corner of the additional square napkin toward an adjacent second corner on the same side of the additional square napkin, the folded additional square napkin having a pair of long sides and a pair of short sides, a first short side placed into the pouch and the second short side extending out the top of the pouch.

3. A decorative holder for setting a table, comprising:

a pair of square napkins, the square napkins each having four sides and four corners, each corner connecting a pair of sides, each corner having an opposing corner, a first napkin of the pair of square napkins having a diagonal line connecting opposing corners, the first napkin of the pair of square napkins folded along the diagonal line, the folded first napkin of the pair of square napkins forming a right triangle with a right angle corner and a pair of acute angle corners and a second square napkin of the pair of square napkins, the second napkin of the pair of square napkins folded into a rectangle by folding a first corner toward an adjacent second corner on the same side of the second square napkin of the pair of square napkins, the folded second napkin of the pair of square napkins forming a rectangle having a pair of long sides and a pair of short sides;

a place setting of flatware, the flatware placed on the first napkin of the pair of square napkins, the first napkin of the pair of square napkins enfolding the flatware by folding the acute angle corners towards each other; and a pouch, having an open top, a pair of closed sides and a closed bottom, the place setting of flatware and the pair of napkins inserted into the pouch, the flatware enfolded by the first square napkin of the pair of square napkins folded into the triangle, the bottom of the flatware and the first napkin of the pair of square napkins inserted into the pouch through the open top, a short side of the second napkin of the pair of square napkins inserted into the pouch behind the first napkin of the pair of square napkins, the place setting of flatware and the pair of napkins extending out of the open top of the pouch, the pouch with the flatware and the pair of napkins placed on a table for use by a guest while dining.

4. The decorative holder as described in claim 3, wherein the decorative holder is for setting the table for a festive celebration, the pouch having at least one ornamentation, the ornamention selected to complement a decorating motif associated with the festive celebration.

5. The decorative holder as described in claim 3, wherein the place setting of flatware contains at least one utensil selected from the group consisting of a pair of chopsticks, a knife, a fork and a spoon.

6. The decorative holder as described in claim 3, wherein a name of a guest is written on the pouch, the decorative holder functioning as a place card for the table having assigned seats, the holder indicating to the guest where the assigned seat is for the guest.

7. The decorative holder as described in claim 3, wherein the first napkin is cut along the diagonal fold line.

* * * * *